US008214919B2

(12) United States Patent
Gafforio et al.

(10) Patent No.: US 8,214,919 B2
(45) Date of Patent: Jul. 10, 2012

(54) CONTROL DEVICE FOR THE POSITION OF A PROTECTIVE HELMET'S VISOR

(75) Inventors: Luca Gafforio, Cumun Nuovo (IT); Gabriele Tomasoni, Bariano (IT); Alberto Salvetti, Bergamo (IT)

(73) Assignee: Opticos S.R.I., Brembate di Soppa (IT)

( * ) Notice: Subject to any disclaimer, the term of this patent is extended or adjusted under 35 U.S.C. 154(b) by 758 days.

(21) Appl. No.: 11/540,957

(22) Filed: Oct. 2, 2006

(65) Prior Publication Data

US 2007/0074335 A1 Apr. 5, 2007

(30) Foreign Application Priority Data

Sep. 30, 2005 (IT) ..... MI2005A1839

(51) Int. Cl.
*A42B 3/22* (2006.01)
*A42B 1/06* (2006.01)

(52) U.S. Cl. ..... 2/6.5; 2/6.3; 2/410

(58) Field of Classification Search ..... 2/410, 6.3, 2/6.5, 6.7, 171, 171.4, 173, 424; 16/324, 16/325, 326, 327, 328, 329, 330, 331, 332, 16/349, 352, 353
See application file for complete search history.

(56) References Cited

U.S. PATENT DOCUMENTS 4,807,305 A * 2/1989 Sundahl ..... 2/424
5,461,731 A 10/1995 Shida
6,125,477 A 10/2000 Crippa et al.
6,253,386 B1 7/2001 Gafforio et al.
6,795,977 B2 * 9/2004 Basson et al. ..... 2/422
2003/0088907 A1 5/2003 Gafforio et al.
2004/0049830 A1 3/2004 Gafforio et al.
2006/0117467 A1 * 6/2006 Choi et al. ..... 2/424

FOREIGN PATENT DOCUMENTS

EP 0 629 357 A2 12/1994
EP 0 966 894 A1 12/1999
EP 1 057 419 A1 12/2000
EP 1 397 969 A1 3/2004

* cited by examiner

*Primary Examiner* — Alissa L Hoey
*Assistant Examiner* — Amber Anderson
(74) *Attorney, Agent, or Firm* — Nixon & Vanderhye P.C.

(57) ABSTRACT

Control device for positioning a visor for protective helmets, wherein the visor is rotatable from a configuration fully superimposed on the front opening of the protective helmet to a configuration of partial or total disengagement from said opening. The device includes structure to reversibly lock the visor in at least one position relative to the front opening. The structure to lock the visor includes a control element anchored, with at least a degree of freedom, to the visor, coupled to which is at least one tooth or pin, for engagement with at least one stop or seat, integral with the cap of the helmet. The control element is movable between a first stable position in which it controls engagement of the tooth with the relative stop or seat, and at least a neutral position in which it controls disengagement of said tooth from the relative stop or seat.

42 Claims, 5 Drawing Sheets

CONTROL DEVICE FOR THE POSITION OF A PROTECTIVE HELMET'S VISOR

The present invention relates to a device to control the position of a visor for protective helmets, in particular for motorcyclists, of the kind wherein the visor is rotatable from a configuration fully superimposed on to a configuration partially or fully disengaged from the front opening of the helmet, and in which manually operated means are also provided to reversibly lock the visor in one or more positions in relation to said front opening.

It is known in the art to anchor the visor of a protective helmet to the relative cap, attaching the lateral ends of said visor to suitable mechanisms fastened to the cap, at the lateral regions of the helmet at the edges of said front opening.

These mechanisms, which usually allow the visor to be disengaged from the cap by means of a sequence of manual operations, if necessary using specific tools, are provided with a pin around which the visor can rotate and can also comprise, or be associated with, a device to control the position of the visor which has means to retain, in predefined positions, the visor with respect to the front opening of the helmet.

The most simple means known to hold the visor in predefined positions with respect to the opening of the helmet comprise an elastic tooth, or pin, integral with the visor—or with the cap—suitable to engage in a rack, respectively integral with the cap—or with the visor—during rotation of said visor with respect to the cap. Engagement of the elastic tooth, or pin, in the indentations of the rack determines a plurality of stable positions for the visor with respect to the cap, corresponding to configurations of the visor totally, partially or not superimposed on said front opening of the helmet.

Rotation of the visor from one stable position to the other requires the use of a force sufficient to deform the elastic tooth to consequently allow passage of the tooth from one indentation of the rack to another.

Technically equivalent solutions to the one proposed above, for example in which a tooth, elastic or not, engages with a rack having elastic separators between the indentations, are also known in the art.

Alternatively, or additionally to the solution described above, control devices are known for positioning the visor with respect to the front opening of the helmet wherein a specific pin, or tooth, integral in rotation with the cap, and usually elastic, can be manually engaged or disengaged, by the user of the helmet, in or from a specific seat, or from a relative stop, integral with the visor, by operating a control element of said tooth or pin, in order to prevent rotation of the visor with respect to the cap.

The tooth, or pin, and the relative seat, or stop, are usually shaped and positioned in relation to each other so that disengagement of the tooth, or pin, from the relative seat, or stop, to again allow rotation of the visor with respect to the cap, is not only possible when the user manually disengages said tooth, or pin, from the relative seat, or stop, but also when the force of rotation exerted by the user on the visor exceeds a certain threshold, to which, due for example to an elastic deformation of the tooth and/or of the seat, said disengagement of the tooth from said seat, or stop, corresponds.

It is understood that hereunder the term "tooth" or "pin" is intended as any opposing element which, being reversibly engageable in a seat or with a corresponding stop, directly or indirectly determines the stop of the movable element with which it is associated. In this sense, the "tooth" can have any shape that allows it to effectively and reversibly engage with a relative seat or with a relative stop, and can for example be a simple prism-shaped, hook-shaped or wedge-shaped projection.

European patent EP-A-0 783 842 filed in the name of EDC SA describes a similar device in which, besides means to extemporaneously hold the visor in predefined positions, of the type comprising an elastic pin integral with the cap suitable to engage in a rack integral with the visor, also comprises manually operated means to reversibly and stably fasten the visor in a position fully or partially superimposed with respect to the front opening of the helmet.

In particular, the above cited patent teaches how to produce a stop tooth, formed by the end of a relative arm, which is controlled by a knob revolving with respect to the visor and to the cap, and is movable between a position in which it engages with a stop produced on the visor, in order to prevent rotation thereof, and a position in which said tooth is disengaged from said stop, and therefore does not obstruct rotation of the visor.

The stop tooth is also integral with an elastic pin, also anchored to the revolving knob, which, engaging removably in seats produced in a sleeve integral with the cap, allows said stop element to remain stably in the preselected position and thus hold the visor in a specific position with respect to the cap. The elasticity of the pin associated with the stop pin, its form and the form of the corresponding seats, also allow the user to release said stop tooth from its position engaged with the stop of the visor, and thereby restore rotation of said visor, if the user rotates the control knob to disengage the tooth from the stop or also if the user exerts sufficient rotation force on the visor.

The EDC solution, although considerably effective and safe to use, is nonetheless somewhat complex, as it requires the use of a plurality of mechanical parts, the assembly of which can be difficult and the tolerances of which must be carefully checked.

Moreover, continuous engagement of the elastic pin associated with the stop element with the sleeve and relative seats during rotation of the visor with respect to the cap can cause the elastic properties of said pin to fail and a certain degree of wear of the mutually sliding parts.

The patent EP-A-0 686 357, again by the applicant EDC, describes a device to control the position of the visor with respect to the front opening of the helmet, in which a slider mounted on the chin guard of the helmet in the area in which the visor abuts with said chin guard, slides between a position of engagement with and a position of disengagement from said visor.

More specifically, the slider comprises a shaped tooth which can engage with an external protrusion provided on the inferior end portion of the visor. When the visor fully closes the front opening on the chin guard and the slider is in said disengaged position, sliding of said slider in its engage position causes said tooth to abut over the external protrusion of the visor, to prevent it from being lifted.

If the visor is not in the position fully superimposed on the front opening and the slider is placed in its aforesaid engaged position, subsequent lowering of the visor causes the relative protrusion to abut on the tooth of the slider, so that to prevent total closing of the visor and thus allow a gap for air to pass inside the helmet.

Also in this EDC solution, the specific form of the tooth integral with the slider and of the protrusion of the visor still allow the user to lift the visor, although exerting a greater force, if it is held closed by the tooth of the slider.

Also in this case, although the solution provided by the patent EP-A-0 686 357 is extremely effective and safe, it requires the use of a plurality of mutually sliding mechanical parts, which are thus subject to wear, and the production and relative assembly of which can be complex and costly.

Moreover, if it is necessary to replace this control device for the positioning of the visor, the entire device, and possibly the visor itself, must be detached from the chin guard and replaced with manual operations that the average user is not always capable of performing.

European patent EP-A-1 260 148 in the name of SHOEI teaches how to produce a device to control the position of the visor with respect to the cap, in which a control lever pivoted to the cap, according to an axis parallel to the axis of rotation of said visor, can be rotated by the user between a first position in which a stop tooth, revolving in one piece with the lever, engages with a relative stop produced on the visor, when said visor reaches at least a predefined angle of rotation with respect to the front opening of the helmet, and a position in which said stop tooth does not interfere with said stop.

Besides the usual means to extemporaneously hold the visor in predefined positions, of the type comprising an elastic tooth integral with the cap and a rack integral with the visor, the SHOEI device also comprises a shoulder, also made to rotate by said control lever, the function of which is to lift the visor by a few degrees from its position fully superimposed on the front opening of the helmet.

In this position of partial and reduced lifting of the visor, said stop tooth does not engage with the relative stop of the visor and therefore further closing rotation of the visor can be performed by the user without requiring any particular force greater than the customary force required to rotate the visor when, by means of the relative stop, it does not engage with the stop tooth.

Although the SHOEI solution is not devoid of a certain degree of effectiveness, its mechanics are considerably complex, both due to the number of parts required and due to their form and reciprocal interference and, moreover, as there are no means to lock the visor in the partially lifted position, which can be obtained using said control lever, the visor can undesirably close without effort when in this position.

Finally, in the case in which, due to unavoidable wear of the parts, and in particular of the stop tooth, the device to control the position of the visor should need to be replaced, the SHOEI mechanism requires the user to perform a difficult operation to detach and mount the visor and said control mechanism.

The object of the present invention is to provide a device to control the position of the visor of a protective helmet, in particular for motorcyclists, of the aforesaid type, which does not have the drawbacks of prior art and which is therefore mechanically simple, easy to perform maintenance on and to replace, and very reliable and safe.

Another object of the present invention is to provide a device to control the position of the visor of a protective helmet, in which it is possible for the user to manually block, reversibly, rotation of the visor with respect to the cap in a plurality of positions, including a position of partial and slight lifting of the visor with respect to its position fully superimposed on the front opening of the helmet.

A further object of the present invention is to provide a device to control the position of the visor of a protective helmet which is reliable, subject to reduced wear, very safe to use and which can also be simply operated by the user.

These and other objects are attained by the control device for positioning the visor of a protective helmet according to the first independent claim and the subsequent dependent claims.

According to the present invention, the device to control the position of the visor of a protective helmet, of the kind wherein the visor is rotatable from a configuration fully superimposed on the front opening of the protective helmet to at least a configuration partially or totally disengaged from said front opening, comprises manual operation means to reversibly lock the visor in at least one of its position in relation to the front opening. Advantageously, these means to lock the visor comprise a control element anchored with at least a degree of freedom to the visor, and coupled with which is at least one tooth, or pin, suitable to engage with at least one stop, or seat, integral, directly or indirectly, with the cap of the helmet. The control element is movable between at least a first stable position, in which it controls engagement of the tooth, or pin, with the stop, or seat, to prevent or obstruct further rotation of the visor, and at least a neutral stable position in which it controls disengagement of the tooth, or pin, from the relative stop, or seat, in order to restore the normal possibility of rotation of the visor with respect to the cap.

The fact that the means to manually lock the visor with respect to the cap, or the control element and the relative stop tooth, are directly anchored to the visor itself allows simplification of the control device for positioning the visor, application of said device to pre-existing pivot mechanisms of the visor, and also facilitates the operations to replace said device.

In fact, said manual means to lock the visor can be formed of a simple lever with two arms pivoted to said visor and provided, at the ends of the arms, with at least one stop tooth suitable to engage in a relative seat integral with the cap, for example already present in a pre-existing pivot mechanism of the visor.

Moreover, if due to sliding friction between the parts it becomes necessary to replace the means to lock the visor, these can be easily replaced together with the visor, without requiring to detach parts anchored to the cap besides the visor.

According to a particular aspect of the device according to the present invention, said control element is anchored to the visor removably, for example by interlocking following elastic deformation of some walls of the control element and/or of the visor. In this case, replacement of the control element, in the case of wear, can take place not only through replacing the visor, but also by simply removing said control element from the visor.

According to a preferred aspect of the present invention, said control element is associated with two stop teeth designed to engage in two corresponding seats, or with two corresponding stops, integral with the cap, so that it is possible to hold the visor stably in two predefined positions with respect to the cap, preferably with the visor differently partially and/or fully superimposed on the front opening of the helmet. In this case, the control element is movable between a first stable position in which it controls engagement of one of the two teeth with the relative stop, or seat, a second stable position in which it controls engagement of the other of the two teeth with the relative stop, or seat, and a neutral stable position in which it controls disengagement of both teeth from the relative stops, or seats.

In a preferred embodiment of the present invention, said first stable position corresponds to the configuration with the visor fully superimposed on the front opening of the cap and said second stable position corresponds to a configuration with the visor only partially superimposed on the front opening of the cap. In particular, said second stable position in which the visor is partially superimposed on the front opening can be selected so that the visor is almost fully superimposed on the front opening, in order to form only a thin gap between visor and front opening, to allow a controlled flow of air between the visor and said front opening, with a demisting and/or cooling function for the pilot.

Described hereunder, purely by way of a non-limiting example, is a preferred embodiment of the present invention, with reference to the attached figures, in which:

FIGS. 1*a* and 1*b* are exploded views, taken from visual angles placed at 180.degree. from each other, of a pivot mechanism of the visor associated with a control device for positioning the visor, according to a particular aspect of the present invention;

FIGS. 2*a* and 2*b* show, respectively in perspective and top plan views, the control element of the stop teeth of the specific device to control the position of the visor visible in FIGS. 1*a* and 1*b*, according to a preferred aspect of the present invention;

Figure 1A:
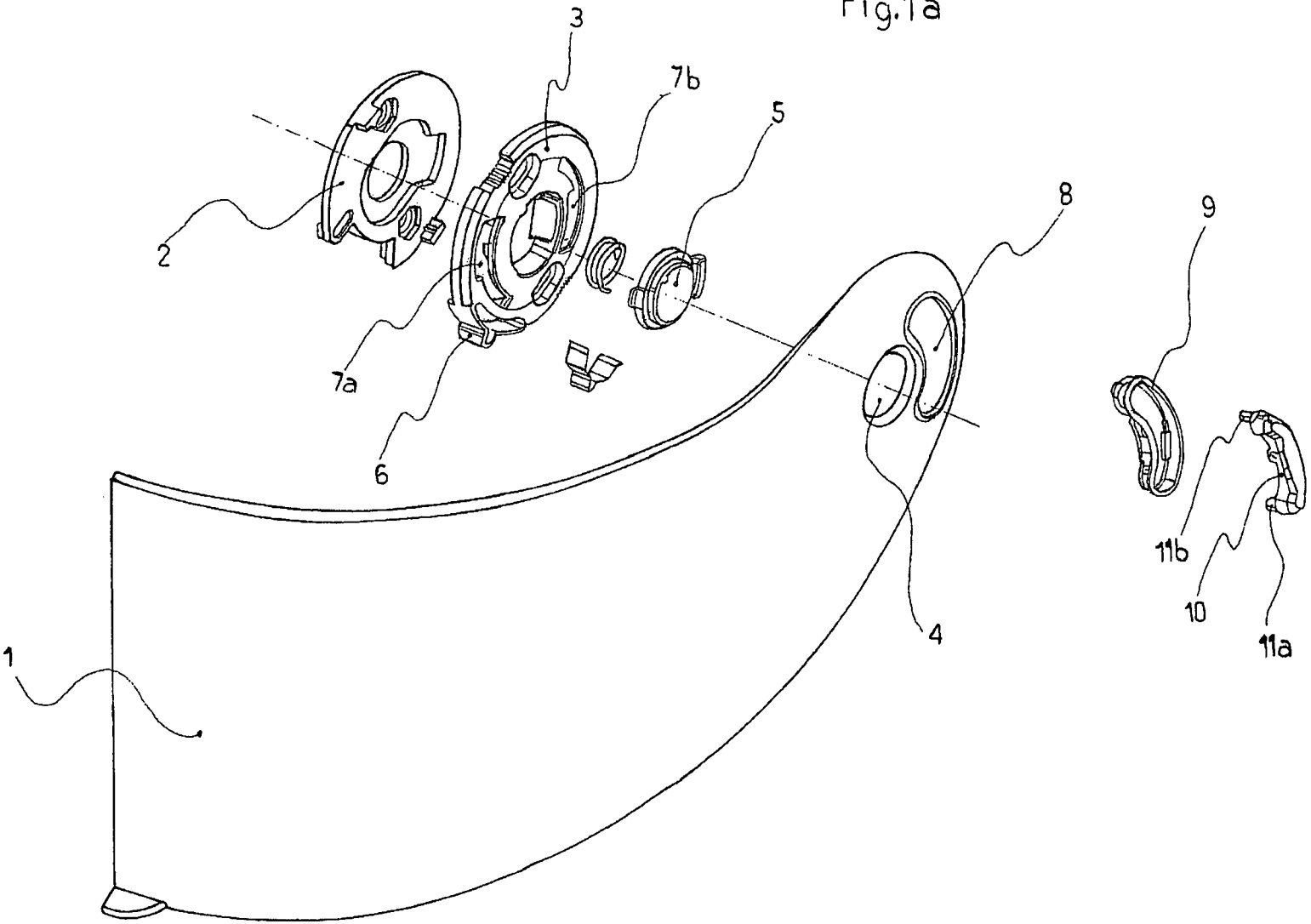
Figure 1B:
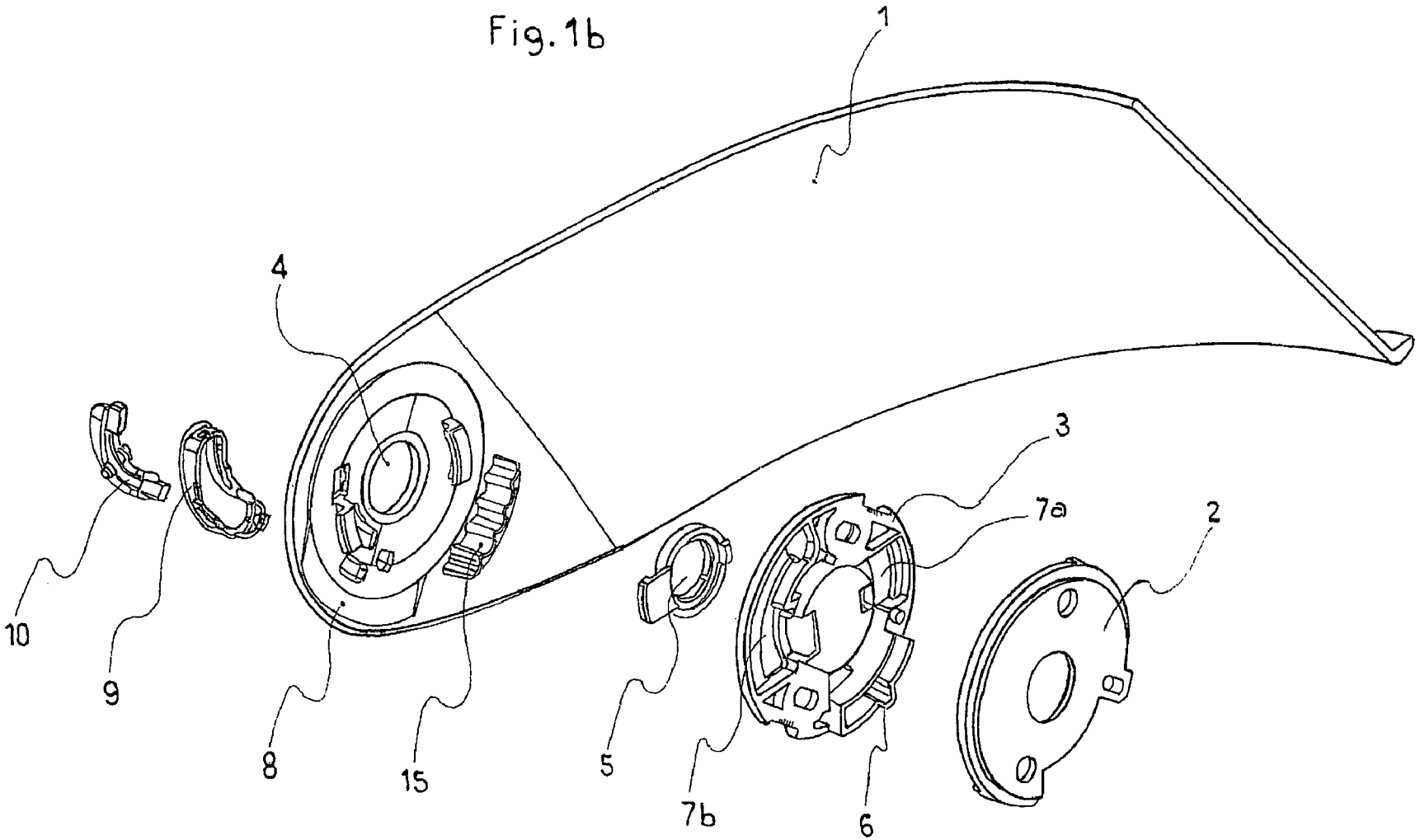
Figure 2A:
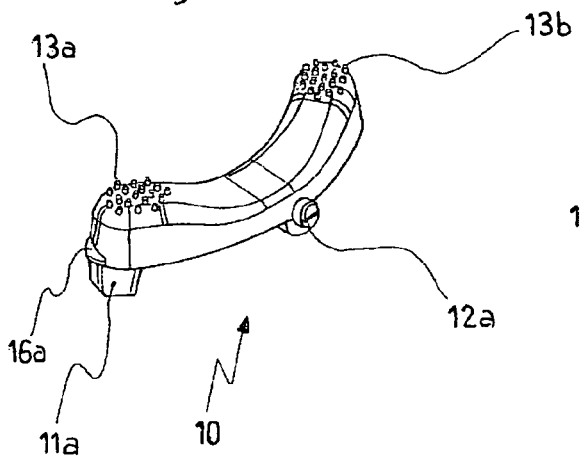
Figure 2B:
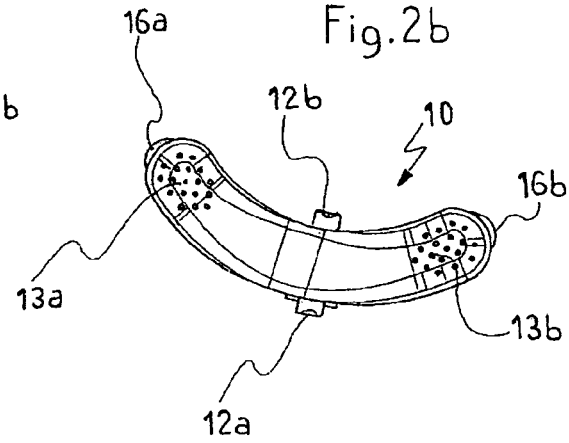
Figure 3:
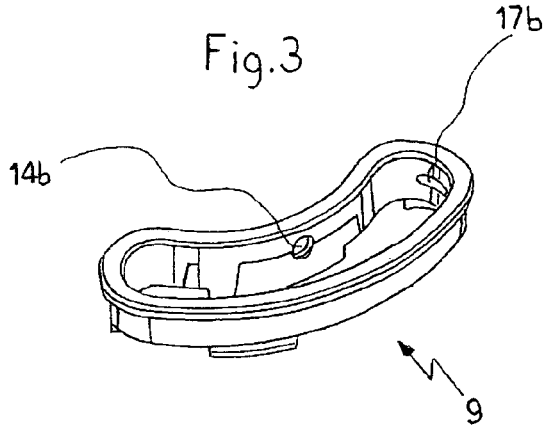
FIG. 3 shows a perspective view of a supporting and mounting frame of the control element shown in FIGS. 2*a* and 2*b* on the visor of the protective helmet described hereunder.
Figure 4:
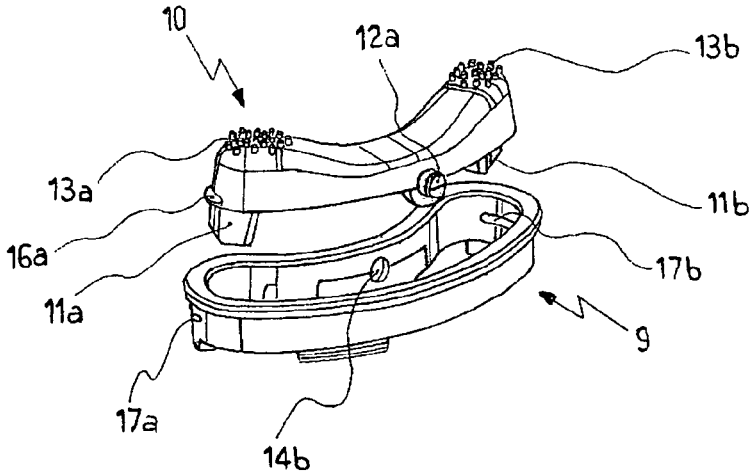
FIG. 4 shows a perspective view of the control element and of the relative frame shown in the previous FIGS. 2*a*, 2*b* and 3.

FIGS. 1*a* and 1*b* show, by way of example, part of a mechanism to pivot a visor 1 to the cap of the protective helmet for motorcyclists, at the lateral ends of the front opening of said helmet.

The mechanism illustrated, per se known from the European patent application EP-A-1 397 969 by the same Applicant, comprises a base 2, intended to be fastened, for example through threaded means, to the cap of the protective helmet, an intermediate body 3, anchored integral to said base 2 and provided with grooves 7*a*, 7*b*, suitable to rotatingly anchor the visor 1 to said mechanism, and an elastic pin 5 which, engaging with the intermediate body 3 and with a corresponding circular hole 4 produced at the sides of the visor 1, defines the axis of rotation about which said visor 1 rotates.

The elastic pin 5, as better described in said patent application EP-A-1 397 969, is mounted elastically, axially slidingly, on the cap of the protective helmet, and does not only perform the function of axis of rotation for the visor, together with the grooves 7*a*, 7*b*, but also allows manual detaching and mounting of said visor 1, interfering or not interfering with said grooves 7*a*, 7*b*, as a function of its position in relation to said cap.

The protective helmet represented in the figures also comprises a device to control the position of the visor 1 with respect to the front opening, of the type comprising manually operated means 8, 9, 10, 7*b* to reversibly lock said visor 1 in one or more positions in relation to said front opening of the helmet.

Advantageously, said means comprise, with reference in particular to FIGS. 2*a*, 2*b*, 3 and 4, a control element 10, anchored with at least a degree of freedom to the visor 1, coupled with at least one tooth 11*a*, 11*b* to engage with a relative stop, or seat, of groove 7*a*, 7*b*, integral with the cap of the helmet. The control element 10 is also shaped so that it is movable between at least a first stable position, in which it controls engagement of the tooth 11*a*, 11*b* with the relative stop, or seat, and at least a neutral stable position in which it controls disengagement of the tooth 11*a*, 11*b* from said stop, or seat.

More specifically, in the particular embodiment illustrated here, the control element 10 is composed of a lever with two arms 13*a*, 13*b*, centrally pivoted, and mounted inside a shaped slot 8 produced on the visor 1, by means of a supporting frame 9.

The frame 9 and the slot 8 are formed to couple reciprocally with interference, for example by elastic projections produced on said frame 9, to make said parts integral with each other, while the lever 10 can be provided with pins 12*a*, 12*b* designed to be inserted, for example following elastic deformation of said pins 12*a*, 12*b* inside corresponding holes 14*b* present in the frame 9 and thereby act as a pivot for the two arms 13*a*, 13*b*.

It must be noted that the relative dimensions, and consequently the reciprocal interference, as well as the mutual form of the frame 9 and of the slot 8, can advantageously be designed to allow the user, by exerting a certain amount of force, to remove the frame 9, and consequently the lever 10, from the visor 1, if the user wishes to replace or perform maintenance on these elements of the device to control the position of the visor 1, described here. Alternatively, as already mentioned, the lever 10 and the frame 9 can be replaced through replacing the whole visor 1.

The inferior portions of the arms 13*a*, 13*b*, i.e. those facing the cap of the helmet when the lever 10 is mounted on the visor 1 through said frame 9, are also provided with teeth 11*a*, 11*b*, intended to engage with respective seats, or stop surfaces, integral with the cap which, in the particular embodiment of the invention illustrated here, are formed of the superior and inferior end regions of the groove 7*b*, produced in the intermediate body 3 of the pivot mechanism of the visor 1 to said cap.

Therefore, the purpose of the curved form, in the plane, of the lever 10, and consequently of the frame 9 and of the slot 8, is to allow coupling of the teeth 11*a*, 11*b* with the groove 7*b*, also curved, and in particular with its inferior and superior end walls. The slot 8 is also positioned concentrically to the rotation hole 4 of the visor 1, so that it corresponds with said groove 7*b*.

The position of the slot 8 on the visor 1, or of the frame 9 and of the control lever 10 when these are assembled, is advantageously located in proximity to the axis of rotation of the visor 1, or in the region anchoring it to the relative pivoting mechanism of the visor 1, so that it is easy for the user to locate and operate said lever 10.

It must be noted that the use of a lever 10 anchored in rotation, due to the pins 12*a*, 12*b*, to the frame 9, in turn fitted in the slot 8 of the visor 1, is advantageous with respect to the alternative use, although possible, of a slider sliding on said visor 1, as the mechanical parts in mutual contact, and thus subject to wear, are in this case larger and subject to sliding friction, while in the solution described here these parts are limited solely to the pins 12*a*, 12*b* engaged with the relative holes 14*b* of the frame 9, parts which are moreover prevalently subject to rolling friction.

The dimensions and the shape of the teeth 11*a*, 11*b* of the lever 10 and of the groove 7*b*, in the embodiment of the invention illustrated here, are such to allow the lever 10, when operated by the user, to reach three stable positions respectively and alternatively corresponding to engagement of the tooth 11*a* with the inferior region (see FIGS. 1*a* and 1*b*) of the groove 7*b*, engagement of the tooth 11*b* with the superior region of the groove 7*b*, and disengagement of both teeth 11*a*, 11*b* from the groove 7*b* (corresponding to the neutral position of the lever 10).

Alternative engagement of the teeth 11*a*, 11*b* with the respective end regions of the groove 7*b* thus causes locking, although not permanent, of the visor 1 with respect to the front opening of the protective helmet in two predefined positions.

In the particular embodiment of the present invention illustrated here, one of these predefined positions coincides with the position of the visor 1 totally superimposed on the front opening of the helmet, while the other predefined position corresponds to a position of the visor 1 partially superimposed on the front opening, so that a gap is created between said opening and said visor 1 to allow a controlled, limited amount of air to flow into the helmet.

In this case, the inferior end wall of the groove 7*b* forms a stop for the tooth 11*a*, capable of preventing all undesirable movement in the direction of rotation corresponding to lifting of said visor 1 with respect to the front opening of the helmet, while the superior end wall of the groove 7*b* forms a stop for the tooth 11*b*, capable of preventing further lowering of the visor 1 with respect to said front opening.

It must be observed that, alternatively to the embodiment illustrated here, by way of example, appropriate notches or projections can be produced at one and/or other of said end regions of the groove 7*b*, to define seats inside which one or other of the teeth 11*a*, 11*b* can be inserted to temporarily lock the rotation of the visor 1. These notches or projections can therefore have the function of defining two opposed stop walls for the tooth 11*a*, 11*b* engaged therein, and consequently prevent any rotation of the visor 1 with which the tooth 11*a*, 11*b* is integral.

In the advantageous embodiment of the lever 10 and of the relative frame 9 illustrated here, moreover, the lever 10 is also provided with two tabs 16*a*, 16*b*, substantially located at the ends of the arms 13*a*, 13*b* and designed to abut on the superior edge of the frame 9 or to be inserted alternatively in corresponding engaging slots 17*a*, 17*b* produced in the lateral walls of said frame 9.

Insertion of said tabs 16*a*, 16*b* in the relative slots 17*a*, 17*b*, in the embodiment of the present invention illustrated here, is made possible by the elasticity of the walls of said slots 17*a*, 17*b* and/or by the elastic deformability of the lever 10, or of its arms 13*a*, 13*b*. Nonetheless, this insertion can also be permitted, or facilitated, by possible elastic deformability of said tabs 16*a*, 16*b*.

More specifically, the tabs 16*a*, 16*b* are thrust to engage in the respective slots 17*a*, 17*b* only when, due to operation of one of the arms 13*a*, 13*b* by the user, the relative teeth 11*a*, 11*b* are engaged with the corresponding inferior and superior end walls of the groove 7*b*, thus forming a further obstruction to rotation of the lever 10, in the case in which it is in any one of the two aforesaid predefined positions to lock the visor 1 with respect to the cap.

Instead, when the lever 10 is in said neutral position, such tabs 16*a*, 16*b* are disengaged from the respective slots 17*a*, 17*b* and are abutting against the superior edge of the frame 9, so that rotation of the lever 10 in one of the two predefined positions to lock the visor 1 is obstructed by the resistance offered by one or other of these tabs 16*a* or 16*b*.

Figure 8:
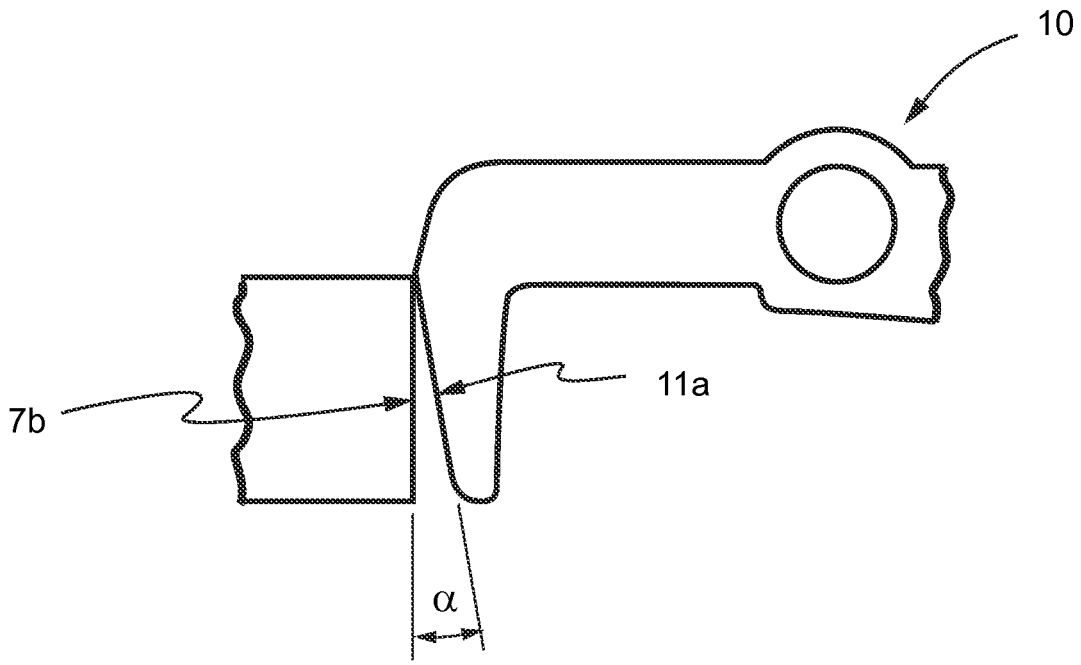
FIG. 8 is a schematic sectional view showing a tooth engagement surface with its respective step surface.

According to another particularly advantageous aspect of the present invention, the teeth 11*a*, 11*b* are tapered towards the end, and are preferably wedge-shaped (as shown in FIG. 8), so that engagement of said teeth 11*a*, 11*b* with the relative stop walls of the groove 7*b* is not permanent when the user, rotating the lever 10 about the pins 12*a*, 12*b* (see also FIG. 1*a*) in one direction or the other, engages one of said teeth 11*a*, 11*b* with the corresponding stop wall of the groove 7*b*. The tooth surface that engages the relative stop or seat is substantially sloping at a non-zero angle a relevant to the corresponding stop surface.

In other words, the slope of the walls of the teeth 11*a*, 11*b* that abut on the respective stop walls of the groove 7*b* allows the user to release said teeth 11*a*, 11*b* from the respective stops of said groove 7*b*, if the user exerts on the visor 1 a rotational force sufficient to cause the tooth 11*a* or 11*b*, engaged with the relative stop, to disengage from the groove 7*b*, with consequent rotation of the lever 10 to its neutral position.

In this case, this rotational force of the visor 11 must also be sufficient to disengage the tab 16*a* or 16*b* from the corresponding slot 17*a* or 17*b* of the frame 9, in which it is engaged, i.e. it must be capable of causing an elastic deformation of the engaged walls of the corresponding slot 17*a* or 17*b*, or also to cause an elastic deformation of the entire lever 10, to allow release of said tab 16*a* or 16*b* from the relative slot 17*a* or 17*b*, following rotation of the lever 10.

According to another aspect of the present invention, the device to control the position of the visor 1 also comprises a rack 15 (FIG. 1*b*) integral in rotation with the visor 1, which engages with an elastic tooth 6, integral with the intermediate body 3 of the mechanism to pivot said visor 1 to the cap of the helmet. When the elastic tooth 6 is located in the indentations of the rack 15, the visor 1 is in a stable position and the user must exert a certain amount of force to cause disengagement of the elastic tooth 6 from the indentation in which it is inserted and subsequent engagement in an adjacent indentation, in order to rotate, in one direction or the other, the visor 1 with respect to the cap.

If, as described above, the positions in which the visor 1 is locked by engagement of the teeth 11*a*, 11*b* in the respective stop walls of the groove 7*b* coincide respectively with a first position of the visor 1 fully superimposed on the front opening (i.e. full closure of said opening), and a second position almost fully superimposed (i.e., of limited lifting of the visor 1 from its position of full closure of the front opening), the distance between the indentations of the rack 15 and its form with respect to the elastic tooth 6 can be chosen so that upon reaching said first position to close the front opening, the elastic tooth 6 is housed in one of the slots of the rack 15, while when the visor reaches the second position of limited lifting of the visor 1, the elastic tooth 6 is not inserted in a slot and therefore is not in a position of stable equilibrium.

In this way, when the constraint exerted by engagement of the corresponding tooth 11*b* with the groove 7*b* is removed, the visor 1 tends to rotate until the elastic tooth 6 is inserted in one of the indentations of the rack 15. Careful dimensioning of said parts can, in this case, result in the tooth 6 being thrust into the indentation of the rack 15 corresponding to the position of full closure of the front opening of the helmet by the visor 1.

Operation of the device to control the position of the visor 1 with respect to the cap described above, is illustrated below with reference to FIGS. 5, 6 and 7 attached here.

Figure 5:
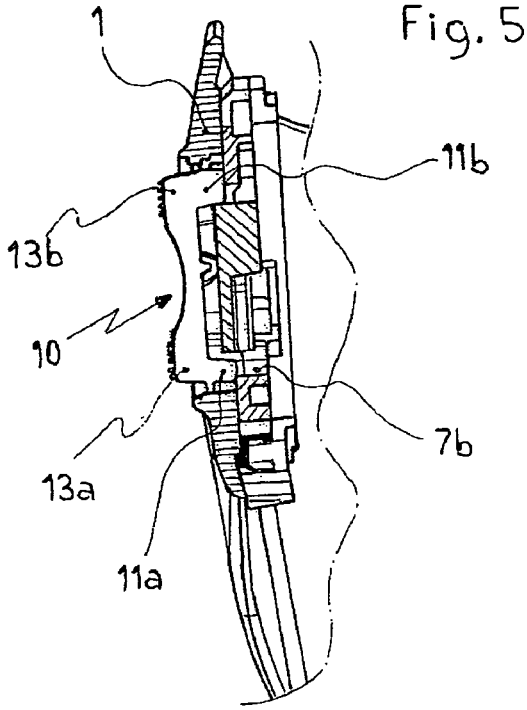
FIG. 5 is a sectional side view of the means to reversibly lock the visor, shown in the previous figures, when these are in a neutral position, that is, releasing rotation of the visor.

When the user intends to rotate the visor 1 with respect to the front opening of the protective helmet, he can place the lever 10, acting according to the initial configuration thereof on one or other of the arms 13*a*, 13*b*, in the neutral position in FIG. 5, wherein the teeth 11*a*, 11*b* are disengaged from the relative stops defined by the groove 7*b* and the tabs 16*a*, 16*b* of the lever 10 are abutting on the outer edge (i.e., facing outwards with respect to the cap) of the frame 9 of said lever 10. In this case, the user is free to rotate the visor 1 with respect to the cap of the protective helmet, having only to exert a force capable of overcoming the slight resistance offered by the elastic tooth 6 when passing from one slot to the other of the rack 15.

Having reached the position with the visor 1 fully superimposed on the front opening of the helmet, if the user decides to hold the visor 1 in this position, he can act on the lever 10 to engage the tooth 11*a* against the inferior end wall of the groove 7*b* and simultaneously cause insertion of the tab 16*a* in the corresponding slot 17*a* of the frame 9, following elastic deformation of the walls of said slot 17*a* and/or of the entire lever 10.

In other words, once the visor 1 has reached full closure of the front opening of the helmet, the user can press the arm 13*a*, until said tooth 11*a* is engaged with said inferior end wall of the groove 7*b* and the tab 16*a* is inserted in the relative slot 17*a* of the frame 9.

In this configuration (visible in FIG. 6), accidental rotation in the direction to lift the visor 1, from the position of full closure of the front opening of the helmet, is prevented not only by engagement of the elastic tooth 6 in the relative last indentation of the rack 15, but also by engagement of the tooth 11*a* with the inferior stop wall of the groove 7*b* and by engagement of the tab 16*a* in the slot 17*a*.

In the case in which the user wishes to then lift the visor 1 from the configuration described above, slight pressure of the arm 13*b* of the lever 10 by the user allows the neutral position of said lever 10 to be reached (FIG. 5), and consequently makes it possible to rotate the visor 1 freely, as described above.

In this case, rotation of the lever 10 not only causes the tooth 11*a* to disengage from the groove 7*b*, but also causes elastic deformation of the slot 17*a*, and/or of the entire lever 10, which allows the tab 16*a* to be released from the relative slot 17*a*, so that the lever 10 is free to rotate about its pins 12*a*, 12*b*. Moreover, in the rotational movement of the lever 10, the tab 16*b*, opposite said tab 16*a*, abuts against the outer edge of the frame 9, thus obstructing further rotation of said lever 10, when it is in its neutral position.

Starting with the visor 1 in a position partially or fully disengaged from the front opening, suitable pressure of the arm 13*b* of the lever 10 by the user determines preliminary insertion of the tooth 11*b* of the lever 10 in the groove 7*b*, although not engaging with the superior stop wall of said groove 7*b*, and corresponding engagement of the tab 16*b* in the slot 17*b*, while, starting with this situation, subsequent rotation to lower the visor 1 by the user causes the tooth 11*b* to abut against the superior stop wall of the groove 7*b* (FIG. 7) and consequently the visor 1 to reach the stable position described above, corresponding to opening of a gap between the visor 1 and the front opening.

Further rotation in the direction to lower the visor 1 is obstructed by engagement of the tooth 11*b* with the superior wall of the groove 7*b* of the mechanism to pivot the visor to the cap, and by engagement of the tab 16*b* with the relative slot 17*b*, while lifting of the visor 1 is not obstructed by said engagement of the tooth 11*b* in the groove 7*b*, or by the tab 16*b* located in the slot 17*b*.

Finally, as already mentioned, the form of the teeth 11*a*, 11*b* and also of the relative stop walls defined in the groove 7*b*, allows the user to release the teeth 11*a*, 11*b* from engagement with said stops, providing the user exerts sufficient lifting or lowering force on the visor 1 to allow slight elastic deformation of the tooth 11*a*, 11*b*, and/or of the relative stop wall, and of the lever 10 and/or the walls of the relative slot 17*a*, 17*b*, which allows said tooth 11*a*, 11*b* to translate with respect to the stop wall and consequently disengage therefrom, also causing rotation of the lever 10 with respect to its pivot 12*a*, 12*b*, to move to said neutral position.

It must be noted that when said rotation force is exerted on the visor 1, which causes simultaneous rotation of the lever 10 due to the suitably shaped teeth 11*a*, 11*b*, the tab 16*a* or 16*b* not engaged in the relative slot 17*a* or 17*b* abuts against the outer edge of the frame 9, thus obstructing further rotation of said lever 10, when it is in the neutral position, and consequently obstructing one or other of the predefined locking positions of the visor from being accidentally established, while substantially facilitating establishment of said neutral position of said lever 10.

Figure 6:
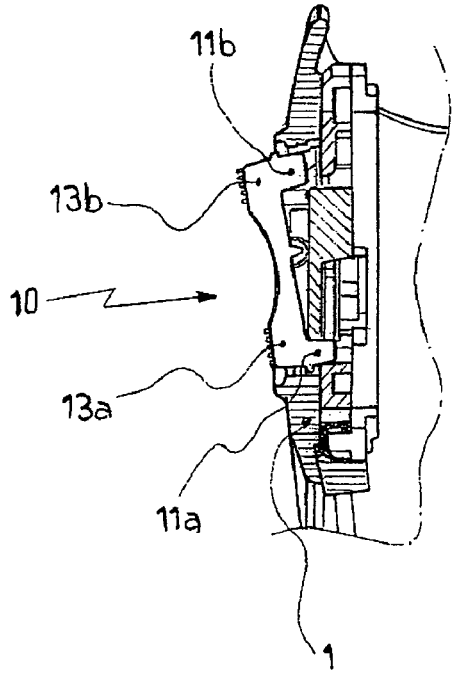
FIG. 6 is a sectional side view of the means to reversibly lock the visor, shown in the previous figures, when these are in a first locking position of the visor.
Figure 7:
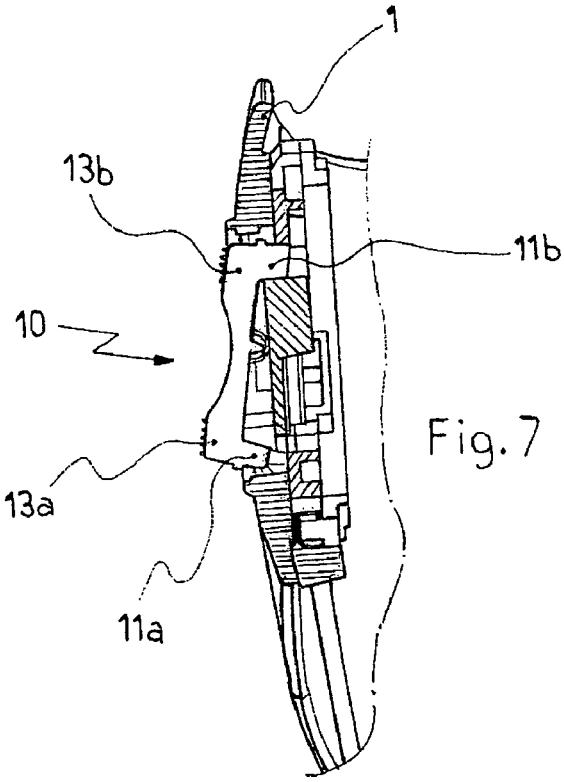
FIG. 7 is a sectional side view of the means to reversibly lock the visor, shown in the previous figures, when these are in a second position to lock rotation of the visor.

In this way, if the user has operated the lever 10 with the visor 1 in the position fully closing the front opening of the helmet to lock the visor in this position and it is therefore in the configuration illustrated in FIG. 6, although engagement of the tooth 11*a* with the inferior end wall of the groove 7*b* obstructs rotation in the direction to lift said visor 1, as does engagement of the tab 16*a* in the slot 17*a*, if the user exerts sufficient rotational force this causes, thanks also to the sloping walls of the tooth 11*a*, relative sliding thereof with respect to the relative stop wall, lifting thereof, release, thanks to the elastic deformability of the lever 10 and/or of the walls of the slot 17*a*, of the tab 16*a* from said slot 17*a*, and subsequent abutting of the other tab 16*b* on the outer edge of the frame 9, thus establishing the neutral position of the lever 10, to consequently allow further rotation to lift the visor 1 by the user.

Analogously, if the user has positioned the visor 1 in the position of limited lifting with respect to the front opening of the helmet and has then locked it in this position by engaging the tooth 11*b* in the groove 7*b* (FIG. 7), thus obstructing further lowering of the visor 1 to close said front opening, the exertion of sufficient downward rotational force on the visor 1 determines sliding of the tooth 11*b* in relation to the stop wall of the groove 7*b*, lifting thereof, disengagement of the tab 16*b* from the slot 17*b*, and rotation of the lever 10 in its neutral position, facilitated by the tab 16*a* abutting against the outer edge of the frame 9, thus allowing further rotation of the visor 1 to close the front opening of the helmet.

This solution, as will be apparent to those skilled in the art, increases the safety of use of the device according to the present invention, preventing any possible, even if unlikely, jamming of the lever 10 from obstructing rotation of the visor 1.

The invention claimed is:

1. A control device to position a visor for a protective helmet, of the type in which said visor is rotatable from a configuration fully superimposed on a front opening of a cap of the protective helmet to at least a configuration partially or fully disengaged from said front opening, said device comprising manually operated locking structure to reversibly lock said visor in a plurality of positions with respect to the helmet, wherein said locking structure comprises a control element that is anchored with at least one degree of freedom to said visor, and has two teeth for engaging with two relative stops or seats provided in a guide groove of a body being integral with the helmet and suitable to pivotally anchor the visor to the helmet, said guide groove is arched with respect to the axis of rotation of the visor, said control element being movable between at least a first stable position, in which it controls engagement of one of said teeth with the relative stop or seat, a second stable position in which it controls engagement of the other said teeth with the relative stop or seat, and at least a neutral position in which it controls disengagement of said teeth from the relative stops or seats, wherein said first stable position blocks the movement of the visor in a direction opposite to that obtained by the second stable position.

2. The device as claimed in claim 1, wherein said control element comprises a lever pivoted in rotation to said visor inside a specific housing.

3. The device as claimed in claim 2, wherein said lever is of the type with two arms with central pivot, each of said two arms being respectively provided with one of said two teeth.

4. The device as claimed in claim 2, wherein said lever is pivoted in rotation to said visor, through interposing of a supporting frame for said lever, said frame being anchorable to said visor inside a slot produced on said visor.

5. The device as claimed in claim 4, further comprising structure to removably anchor the frame to said slot.

6. The device as claimed in claim 1, wherein said control element comprises an anchor to removably anchor the control element to said visor, when said control element is at least in said first stable position thereof in which it controls engagement of said one of said teeth with said relative stop or seat.

7. The device as claimed in claim 6, wherein said anchor comprises at least one tab elastically deformable and integral in movement with said control element, said tab being removably engaged in a relative slot integral with said visor.

8. The device as claimed in claim 1, wherein said at least one stop or seat is integral with said cap through a mechanism to anchor/pivot the visor to said cap.

9. The device as claimed in claim 8, wherein said at least one stop or seat is realized through a housing provided in said anchor/pivot mechanism.

10. The device as claimed in claim 1, wherein at least one of said teeth has a surface to engage with a relative stop or seat, substantially sloping with respect to the corresponding stop surface of said relative stop or seat.

11. The device as claimed in claim 10, wherein at least one of said teeth is substantially wedge-shaped.

12. The device as claimed in claim 1, wherein said at least one first stable position corresponds to said configuration of said visor fully superimposed on the front opening of said cap or to a configuration of said visor only partially superimposed on said front opening of said cap.

13. The device as claimed in claim 12, wherein said second stable position corresponds to a configuration of said visor only partially superimposed on said front opening of said cap or to said configuration of said visor fully superimposed on the front opening of said cap.

14. The device as claimed in claim 12, further comprising at least one elastic tooth, integral with the visor or with the cap, and stably engageable, during rotation of the visor with respect to the cap, in one or more the indentations of a corresponding rack integral with the cap or with the visor, wherein said at least one first stable position and/or a second stable position corresponds to a configuration of the visor with respect to the cap in which said at least one elastic tooth is not inserted in one of said indentations of the rack.

15. The device as claimed in claim 14, wherein said at least one elastic tooth, or said rack, is integral with said cap through a mechanism to anchor/pivot the visor to the cap.

16. The device as claimed in claim 1, further comprising structure to removably anchor the control element to the visor.

17. The device as claimed in claim 1, wherein said control element is located on the visor in proximity to the axis of rotation thereof.

18. A protective helmet including a visor and the control device of claim 1.

19. The device as claimed in claim 1, wherein said one of said teeth is provided on one side of the control element and said other of said teeth is provided to another side of the control element that is opposite to the one side.

20. The device as claimed in claim 1, wherein first and second stable positions correspond to the configuration in which the visor is fully superimposed on the front opening and the configuration in which the visor is partially or fully disengaged from the front opening.

21. A control device to position a visor for a protective helmet, of the type in which said visor is rotatable from a configuration fully superimposed on a front opening of a cap of the protective helmet to at least a configuration partially or fully disengaged from said front opening, said device comprising manually operated locking structure to reversibly lock said visor in a plurality of positions with respect to the helmet, wherein said locking structure comprises a control element that is anchored with at least one degree of freedom to said visor, and has two teeth for engaging with two relative stops or seats provided in a guide groove of a body being integral with the helmet and suitable to pivotally anchor the visor to the helmet, said guide groove is arched with respect to the axis of rotation of the visor, said control element being movable between at least a first stable position, in which it controls engagement of one tooth or pin one of said teeth with said relative stop or seat, and at least a neutral position in which it controls disengagement of said teeth from said relative stops or seats, wherein each of said teeth has a tooth surface to engage with the relative stop or seat, substantially sloping with respect to a corresponding stop surface of the relative stop or seat, whereby each stop surface and each tooth surface may be released from one another without directly manipulating the control element if a sufficient rotational force is applied to the visor to forcibly move the locking structure from the first stable position to the neutral position.

22. The device as claimed in claim 21, wherein said control element is movable between said first stable position in which it controls engagement of one of said teeth with the relative stop or seat, a second stable position in which it controls engagement of the other of said teeth with the relative stop or seat, and said neutral position in which it controls disengagement of said teeth from the relative stops or seats, wherein said first stable position blocks the movement of the visor in a direction opposite to that obtained by the second stable position.

23. The device as claimed in claim 22, wherein said control element comprises a lever pivoted in rotation to said visor inside a specific housing.

24. The device as claimed in claim 23, wherein said lever is of the type with two arms with central pivot, each of said two arms being respectively provided with one of said two teeth.

25. The device as claimed in claim 24, wherein said lever is pivoted in rotation to said visor, through interposing of a supporting frame for said lever, said frame being anchorable to said visor inside a slot produced on said visor.

26. The device as claimed in claim 25, further comprising structure to removably anchor the frame to said slot.

27. The device as claimed in claim 22, wherein said second stable position corresponds to a configuration of said visor only partially superimposed on said front opening of said cap or to said configuration of said visor fully superimposed on the front opening of said cap.

28. The device as claimed in claim 21, wherein said control element comprises an anchor to removably anchor it to said visor, when said control element is at least in said first stable position thereof in which it controls engagement of said one of said teeth with said relative stop or seat.

29. The device as claimed in claim 28, wherein said anchor comprises at least one tab elastically deformable and integral in movement with said control element, said tab being removably engaged in a relative slot integral with said visor.

30. The device as claimed in claim 21, wherein said at least one stop or seat is integral with said cap through a mechanism to anchor/pivot the visor to said cap.

31. The device as claimed in claim 30, wherein said at least one stop or seat, is realized through a housing provided in said anchor/pivot mechanism.

32. The device as claimed in claim 21, wherein at least one of said teeth is substantially wedge-shaped.

33. The device as claimed in claim 21, wherein said at least one first stable position corresponds to said configuration of said visor fully superimposed on the front opening of said cap or to a configuration of said visor only partially superimposed on said front opening of said cap.

34. The device as claimed in claim 33, further comprising at least one elastic tooth, integral with the visor or with the cap, and stably engageable, during rotation of the visor with respect to the cap, in one or more indentations of a corresponding rack integral with the cap or with the visor, wherein said at least one first stable position and/or a second stable position corresponds to a configuration of the visor with respect to the cap in which said at least one elastic tooth is not inserted in one of said indentations of the rack.

35. The device as claimed in claim 34, wherein said at least one elastic tooth or said rack is integral with said cap through a mechanism to anchor/pivot the visor to the cap.

36. The device as claimed in claim 21, further comprising structure to removably anchor the control element to the visor.

37. The device as claimed in claim 21, wherein said control element is located on the visor in proximity to the axis of rotation thereof.

38. The device as claimed in claim 21, wherein only the tooth surface that engages the relative stop or seat is substantially sloping at a non-zero angle relevant to the corresponding stop surface.

39. The device as claimed in claim 21, wherein each tooth surface includes a first tooth surface and a second tooth surface that is arranged substantially perpendicular to the first tooth surface, wherein, in the first stable position, the first tooth surface is arranged to substantially slopingly engage the relative stop or seat, while the second tooth surface does not engage the relative stop or seat.

40. The device as claimed in claim 21, wherein each said teeth and/or each said relative stop or seat is elastically deformable, such that the locking structure is forcibly deformable from the first stable position to the neutral position.

41. The device as claimed in claim 21, wherein each said tooth surface is substantially sloping with respect to the corresponding stop surface of the relative stop or seat in a plane according to which the tooth surface and the stop surface mutually couple.

42. A control device to position a visor for a protective helmet, of the type in which said visor is rotatable from a first configuration fully superimposed on a front opening of a cap of the helmet to at least a second configuration partially or fully disengaged from said front opening, said device comprising manually operated locking structure to selectively and reversibly lock said visor in the first and second configurations, wherein said locking structure comprises a control element that is anchored with at least one degree of freedom to said visor, and first and second teeth coupled with the control element and structured to alternatively engage with corresponding first and second stops, integral with the cap of the helmet, wherein said first tooth engages with said first stop in the first configuration to define a first stable position and the second tooth engages with said second stop in the second configuration to define a second stable position, said control element being movable from the first and second stable positions to a neutral position in which said first and second teeth disengage from the respective first and second stops.

* * * * *